US005438977A

United States Patent [19]

Gomez et al.

[11] Patent Number: 5,438,977

[45] Date of Patent: Aug. 8, 1995

[54] SNORKEL AND BUOYANCY CONTROL APPARATUS

[76] Inventors: Miguel R. Gomez, 7022 Sunset Ave., Panama City, Fla. 32408; Rommie H. Brock, 2639 Feral La., Lynn Haven, Fla. 32444

[21] Appl. No.: 239,578

[22] Filed: May 9, 1994

Related U.S. Application Data

[63] Continuation-in-part of Ser. No. 86,030, Jul. 6, 1993.

[51] Int. Cl.[6] ..... B63C 11/08

[52] U.S. Cl. ..... 128/202.14; 128/201.26; 128/201.27; 128/201.28; 128/200.24; 441/88

[58] Field of Search ..... 128/201.11, 201.26, 128/201.27, 201.28, 200.24, 202.14; 441/88, 114, 115, 116, 117, 118, 124, 135; 405/186

[56] References Cited

U.S. PATENT DOCUMENTS

| | | | |
|---|---|---|---|
| 2,488,261 | 11/1949 | Bedial | 128/201.11 |
| 3,138,155 | 6/1964 | Bould | 405/186 |
| 5,101,818 | 4/1992 | Chace et al. | 128/202.14 |
| 5,295,765 | 3/1994 | Choi | 441/117 |

*Primary Examiner*—Edgar S. Burr
*Assistant Examiner*—William J. Deane, Jr.

[57] ABSTRACT

A snorkel and buoyancy control apparatus is provided for a snorkeler who employs a snorkel tube assembly for receiving inhaled air. The snorkel and buoyancy control apparatus includes a mouthpiece/selector valve assembly, connected to the snorkel tube assembly, for receiving inhaled air from the snorkel tube assembly and for selectively directing exhaled air to either a one-way valve assembly, e.g. flapper valve assembly, or to a buoyancy control vest. The mouthpiece/selector valve assembly includes a selector valve assembly and a mouthpiece assembly which are connected together. The selector valve assembly includes a first manually-actuated output port selector assembly which enables selective direction of exhaled air either to the flapper valve assembly or to the buoyancy control vest. The flapper valve assembly permits one-way flow of exhaled air from inside the selector valve assembly to outside the selector valve assembly. The buoyancy control vest is connected to the selector valve assembly for selectively receiving exhaled air based upon selective operation of the first manually-actuated output port selector assembly. The snorkel tube assembly may be connected to a selector valve assembly portion of the mouthpiece/selector valve assembly. Alternatively, the snorkel tube assembly can be connected to a mouthpiece assembly portion of the mouthpiece/selector valve assembly.

10 Claims, 8 Drawing Sheets

SNORKEL AND BUOYANCY CONTROL APPARATUS

RELATED APPLICATION

This application is a continuation-in-part of prior copending application, Ser. No. 08/086,030, filed Jul. 6, 1993.

BACKGROUND OF THE INVENTION

1. Field of the Invention

The present invention relates generally to snorkels and more particularly, to a snorkel device especially adapted for inflation of a buoyancy control vest.

2. Description of the Prior Art

Snorkels are well known in the art. In a typical snorkel device, air is inhaled through a snorkel tube into a person's mouth. Exhaled air is exhausted to the water or ambient air.

To facilitate flotation of a person who is snorkeling or after snorkeling is completed, a buoyancy control vest is often worn. The buoyancy control vest is inflated with air. When more buoyancy is desired, more air is forced into the buoyancy control vest. Alternatively, when less buoyancy is desired, some air is let out of the buoyancy control vest.

Typically, when a person is finished snorkeling, the person rises to the surface of the water, removes the snorkel from his/her mouth and inflates the buoyancy control vest with more air to facilitate the person's floating high in the water. This sequence of events is often a cause of discomfort for the snorkeler. Not only must the snorkel be removed from the snorkeler's mouth, but the snorkeler must actuate a valve on the buoyancy control vest and begin blowing on the buoyancy control vest as the snorkeler is treading water.

In this respect, it would be desirable if a device were provided which enabled inflation of the buoyancy control vest without requiring the snorkeler to remove the snorkel from his/her mouth. In addition, it would be desirable if a device were provided that permitted the person to inflate the buoyancy control vest without blowing up the buoyancy control vest as the person is treading water with the snorkel out of the mouth.

As mentioned above, the buoyancy control vest is used by the snorkeler as the person is snorkeling. Yet making changes in the inflation of the buoyancy control vest during dives is not contemplated in the prior art. Changes in the inflation of the buoyancy control vest must be made either before or after snorkeling, but not during diving. In this respect, it would be desirable if a device were provided that enabled a snorkeler to change the inflation of the buoyancy control vest while swimming on the surface of the water during a snorkeling operation.

The following U.S. patents have been uncovered which relate to buoyancy control vests: U.S. Pat. Nos. 3,512,196; 4,035,857; 4,379,656; and 5,020,941. In these vests, either the vest is inflated by a user by direct mouth contact on the vest, or the vest is inflated by pressurized air in scuba diving equipment. In this respect, it would be desirable if a device were provided that enabled inflation of buoyancy control vests without direct mouth contact on the vest. Moreover, a person who is snorkeling is not generally wearing scuba diving equipment. In this respect, it would be desirable if a device were provided that enabled inflation of a buoyancy control vest without a pressurized tank such as used in scuba diving equipment.

Thus, while the foregoing body of prior art indicates it to be well known to snorkel and to use buoyancy control vests, the prior art described above does not teach or suggest a snorkel and buoyancy control apparatus which has the following combination of desirable features: (1) enables inflation of the buoyancy control vest without requiring the snorkeler to remove the snorkel from his/her mouth; (2) avoids the necessity of the person inflating the buoyancy control as the person is treading water with the snorkel out of the mouth; (3) enables a snorkeler to change the degree of inflation of the buoyancy control vest during the snorkeling operation; (4) enables inflation of buoyancy control vest without direct mouth contact on the vest; and (5) enables inflation of a buoyancy control vest without a pressurized tank such as used in scuba diving equipment. The foregoing desired characteristics are provided by the unique snorkel and buoyancy control apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a snorkel and buoyancy control apparatus for a snorkeler who employs a snorkel tube assembly for receiving inhaled air. The snorkel and buoyancy control apparatus includes a mouthpiece/selector valve assembly, connected to the snorkel tube assembly, for receiving inhaled air from the snorkel tube assembly and for selectively directing exhaled air to either a one-way valve assembly, e.g. flapper valve assembly, or to a buoyancy control vest. The mouthpiece/selector valve assembly includes a selector valve assembly and a mouthpiece assembly which are connected together. The selector valve assembly includes a first manually-actuated output port selector assembly which enables selective direction of exhaled air either to the flapper valve assembly or to the buoyancy control vest. The flapper valve assembly permits one-way flow of exhaled air from inside the selector valve assembly to outside the selector valve assembly. The buoyancy control vest is connected to the selector valve assembly for selectively receiving exhaled air based upon selective operation of the first manually-actuated output port selector assembly.

The snorkel tube assembly may be connected to a selector valve assembly portion of the mouthpiece/selector valve assembly. Alternatively, the snorkel tube assembly can be connected to a mouthpiece assembly portion of the mouthpiece/selector valve assembly.

More specifically, the snorkel and buoyancy control apparatus may include a snorkel tube assembly for receiving inhaled air. A selector valve assembly is connected to the snorkel tube assembly, for receiving inhaled air from the snorkel tube assembly and for selectively directing exhaled air to either a flapper valve assembly or to a buoyancy control vest. The snorkel tube may include a one-way valve assembly. The selector valve assembly includes a housing assembly which includes a first selector valve input port. A second selector valve input port is connected to the snorkel tube assembly. A first selector valve output port. A second selector valve output port, and a first manually-actuated output port selector assembly. The first selector valve input port is connected to a mouthpiece output port. The first selector valve output port is vented to outside the selector valve assembly. The second selector valve output port is connected to a buoyancy control vest, and the first manually-actuated output port selector assembly is employed to selectively direct exhaled air from either a mouthpiece assembly to the first selector valve output port for venting the exhaled air or from a mouthpiece assembly to the second selector valve output port for inflating a buoyancy control vest.

A mouthpiece assembly is connected to the first selector valve input port of selector valve assembly for receiving inhaled air from the snorkel tube assembly and for supplying the inhaled air to the snorkeler's mouth and lungs. The mouthpiece assembly includes a mouthpiece output port is connected to the first selector valve input port for permitting air exhaled from the snorkeler's lungs to exit from the mouthpiece assembly and enter the selector valve assembly.

A flapper valve assembly is connected to the selector valve assembly for permitting one-way flow of exhaled air from inside the selector valve assembly to outside the selector valve assembly. The flapper valve assembly is installed across the first selector valve output port of the housing assembly of the selector valve assembly.

A buoyancy control vest is connected to the second selector valve output port of the selector valve assembly. The buoyancy control vest includes a first port is connected to the second selector valve output port of the selector valve assembly.

The first manually-actuated output port selector assembly includes a manually operated valve assembly connected to an interior wall of the housing assembly. The manually operated valve assembly includes a valve element that is capable of manually selectively dosing either the first selector valve output port or the second selector valve output port, and a push-button assembly is connected to the housing assembly and in contact with the valve element, for manually controlling the valve element with respect to the first selector valve output port and the second selector valve output port.

The push-button assembly includes a pivoted shaft element pivotally is connected at a distal end to the valve element. A button element is connected to the pivoted shaft element at proximal end of the pivoted shaft element, and a spring element positioned between the button element and the housing assembly around a portion of the pivoted shaft element, such that the spring element normally urges the valve element into sealing engagement with a valve seat portion of the housing assembly for blocking air flow to the second selector valve output port and the buoyancy control vest, and such that, when the button element is pressed. The valve element is moved from sealing engagement with the valve seat of the housing assembly to sealing engagement with the first selector valve output port.

The housing assembly includes a first housing portion which includes the a selector valve input port and a second housing portion which includes the first selector valve output port and the second selector valve output port. The first housing portion is oriented with respect to the second housing portion at an obtuse orientation angle.

The buoyancy control vest includes an inlet assembly for connection to the selector valve assembly, such that a snorkeler's exhaled air can be directed to the buoyancy control vest, and a manually-operable exhaust valve which permits air to be exhausted from the buoyancy control vest by manual control.

In accordance with another aspect of the invention, the snorkel and buoyancy control apparatus includes a snorkel tube for receiving inhaled air, a first one-way air valve connected to the snorkel tube for permitting air flow into the snorkel tube during inhalation, and a mouthpiece for receiving inhaled air and for supplying the inhaled air to the snorkeler's mouth and lungs. The mouthpiece includes a mouthpiece output port for permitting exhaled air to exit from the snorkeler's mouth. A second one-way air valve is connected to the mouthpiece for permitting air flow from the mouthpiece to a selector valve assembly. The selector valve assembly, connected to the mouthpiece by way of the second one-way air valve, receives exhaled air from the mouthpiece and selectively directs exhaled air to either a first selector valve output port connected to a vent or to a second selector valve output port connected to a buoyancy control vest which includes a first port connected to the selector valve assembly. Air directed to the buoyancy control vest is used to inflate the buoyancy control vest. The selector valve assembly may also include a mode for connecting the buoyancy control vest to the vent to deflate the buoyancy control vest.

The selector valve assembly may further include a third selector valve output port and a second manually-actuated output port selector; and the buoyancy control vest may further includes a second port. The second port of the buoyancy control vest is connected to the third selector valve output port, and the second manually-actuated output port selector controls flow of air from the buoyancy control vest to the first selector valve output port and the vent for deflating the buoyancy control vest.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved snorkel and buoyancy control apparatus which has all of the advantages of the prior art and none of the disadvantages.

It is another object of the present invention to provide a new and improved snorkel and buoyancy control apparatus which may be easily and efficiently manufactured and marketed.

It is a further object of the present invention to provide a new and improved snorkel and buoyancy control apparatus which is of durable and reliable construction.

An even further object of the present invention is to provide a new and improved snorkel and buoyancy control apparatus which is susceptible of a low cost of manufacture with regard to both materials and labor, and which accordingly is then susceptible of low prices of sale to the consuming public, thereby making such snorkel and buoyancy control apparatus available to the buying public.

Still yet a further object of the present invention is to provide a new and improved snorkel and buoyancy control apparatus which enables inflation of a buoyancy control vest without requiring the snorkeler to remove the snorkel from his/her mouth.

Still another object of the present invention is to provide a new and improved snorkel and buoyancy control apparatus which permits a person to avoid inflating the buoyancy control vest as the person is treading water with the snorkel out of the mouth.

Yet another object of the present invention is to provide a new and improved snorkel and buoyancy control apparatus which enables a snorkeler to change the inflation of the buoyancy control vest during the snorkeling operation.

Even another object of the present invention is to provide a new and improved snorkel and buoyancy control apparatus which enables inflation of a buoyancy control vest without direct mouth contact on the vest.

Still a further object of the present invention is to provide a new and improved snorkel and buoyancy control apparatus which enables inflation of a buoyancy control vest without using a pressurized tank such as used in scuba diving equipment.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
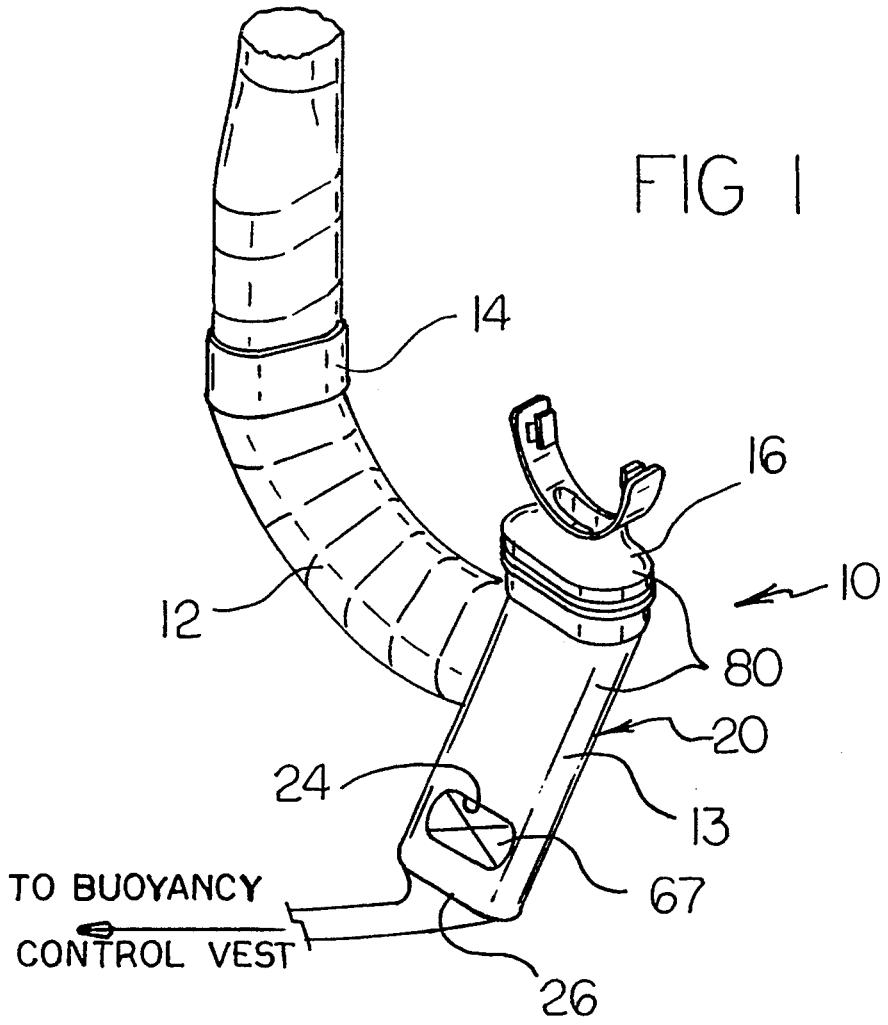
FIG. 1 is an elevational view showing a first preferred embodiment of the snorkel and buoyancy control apparatus of the invention, without a buoyancy vest shown.

With reference to the drawings, a new and improved snorkel and buoyancy control apparatus embodying the principles and concepts of the present invention will be described.

Turning initially to FIGS. 1–6, there is shown a first exemplary embodiment of the snorkel and buoyancy control apparatus 10 that is provided for a snorkeler who employs a snorkel tube assembly 12 for receiving inhaled air. The snorkel and buoyancy control apparatus 10 includes a mouthpiece/selector valve assembly 80, connected to the snorkel tube assembly 12, for receiving inhaled air from the snorkel tube assembly 12 and for selectively directing exhaled air to either a one-way valve assembly, e.g. flapper valve assembly 67, or to a buoyancy control vest 30. The mouthpiece/selector valve assembly 80 includes a selector valve assembly 20 and a mouthpiece assembly 16 which are connected together. The selector valve assembly 20 includes a first manually-actuated output port selector assembly 28 which enables selective direction of exhaled air either to the flapper valve assembly 67 or to the buoyancy control vest 30. The flapper valve assembly 67 permits one-way flow of exhaled air from inside the selector valve assembly 20 to outside the selector valve assembly 20. The buoyancy control vest 30 is connected to the selector valve assembly 20 for selectively receiving exhaled air based upon selective operation of the first manually-actuated output port selector assembly 28.

Figure 7:
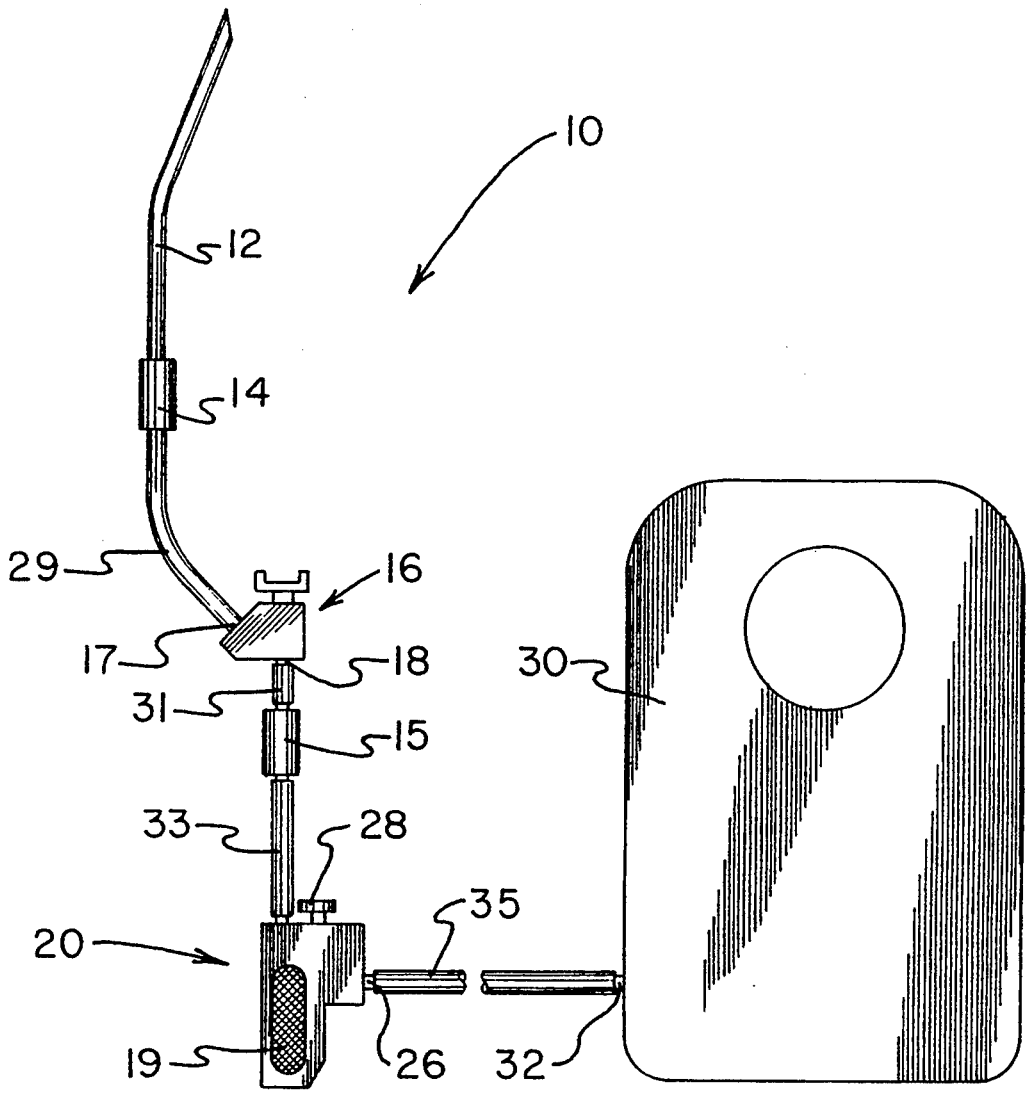
FIG. 7 is an elevational view showing a second preferred embodiment of the snorkel and buoyancy control apparatus of the invention.

The snorkel tube assembly 12 may be connected to a selector valve assembly 20 portion of the mouthpiece/selector valve assembly 80 as shown in FIG. 1. Alternatively, the snorkel tube assembly 12 can be connected to a mouthpiece assembly 16 portion of the mouthpiece/selector valve assembly 80 as shown in FIG. 7.

As shown in the embodiment of the invention shown in FIGS. 1-6, the snorkel and buoyancy control apparatus 10 includes a snorkel tube assembly 12 for receiving inhaled air. A selector valve assembly 20 is connected to the snorkel tube assembly 12, for receiving inhaled air from the snorkel tube assembly 12 and for selectively directing exhaled air to either a flapper valve assembly 67 or to a buoyancy control vest 30. The snorkel tube 12 may include a one-way valve assembly 14. The selector valve assembly 20 includes a housing assembly 13 which includes a first selector valve input port 22. A second selector valve input port 77 is connected to the snorkel tube assembly 12. A first selector valve output port 24. A second selector valve output port 26, and a first manually-actuated output port selector assembly 28. The first selector valve input port 22 is connected to a mouthpiece output port 18. The first selector valve output port 24 is vented to outside the selector valve assembly 20. The second selector valve output port 26 is connected to a buoyancy control vest 30, and the first manually-actuated output port selector assembly 28 is employed to selectively direct exhaled air from either a mouthpiece assembly 16 to the first selector valve output port 24 for venting the exhaled air or from a mouthpiece assembly 16 to the second selector valve output port 26 for inflating a buoyancy control vest 30.

A mouthpiece assembly 16 is connected to the first selector valve input port 22 of selector valve assembly 20 for receiving inhaled air from the snorkel tube assembly 12 and for supplying the inhaled air to the snorkeler's mouth and lungs. The mouthpiece assembly 16 includes a mouthpiece output port 18 is connected to the first selector valve input port 22 for permitting air exhaled from the snorkeler's lungs to exit from the mouthpiece assembly 16 and enter the selector valve assembly 20.

A flapper valve assembly 67 is connected to the selector valve assembly 20 for permitting one-way flow of exhaled air from inside the selector valve assembly 20 to outside the selector valve assembly 20. The flapper valve assembly 67 is installed across the first selector valve output port 24 of the housing assembly 13 of the selector valve assembly A buoyancy control vest 30 is connected to the second selector valve output port 26 of the selector valve assembly 20. The buoyancy control vest 30 includes a first port 32 is connected to the second selector valve output port 26 of the selector valve assembly 20.

The first manually-actuated output port selector assembly 28 includes a manually operated valve assembly 47 connected to an interior wall 49 of the housing assembly 13. The manually operated valve assembly 47 includes a valve element 53 that is capable of manually selectively closing either the first selector valve output port 24 or the second selector valve output port 26, and a push-button assembly 51 is connected to the housing assembly 13 and in contact with the valve element 53, for manually controlling the valve element 53 with respect to the first selector valve output port 24 and the second selector valve output port 26.

The push-button assembly 51 includes a pivoted shaft element 55 pivotally is connected at a distal end to the valve element 53. A button element 57 is connected to the pivoted shaft element 55 at proximal end of the pivoted shaft element 55, and a spring element 61 positioned between the button element 57 and the housing assembly 13 around a portion of the pivoted shaft element 55, such that the spring element 61 normally urges the valve element 53 into sealing engagement with a valve seat portion 83 of the housing assembly 13 for blocking air flow to the second selector valve output port 26 and the buoyancy control vest 30, and such that, when the button element 57 is pressed, the valve element 53 is moved from sealing engagement with the valve seat 83 of the housing assembly 13 to sealing engagement with the first selector valve output port 24.

Figure 4:
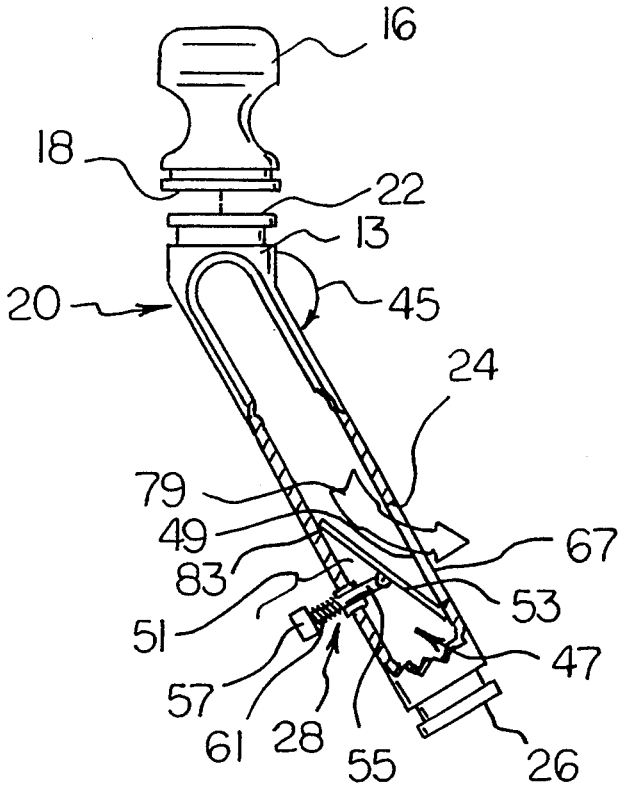
FIG. 4 is partially broken away view of the embodiment of the invention shown in FIG. 2 showing a manually controlled valve in a position directing a diver's exhaled air away from the invention in a snorkel mode.

In operation, as shown in FIG. 4, when the button element 57 is not pressed, the spring element 61 urges the valve element 53 into sealing engagement with the valve seat 83 portion of the housing assembly 13. As a result, air exhaled from a snorkeler (shown by directional arrow 79) is exhausted to the surrounding water through the first selector valve output port 24 and the flapper valve assembly 67.

Figure 5:
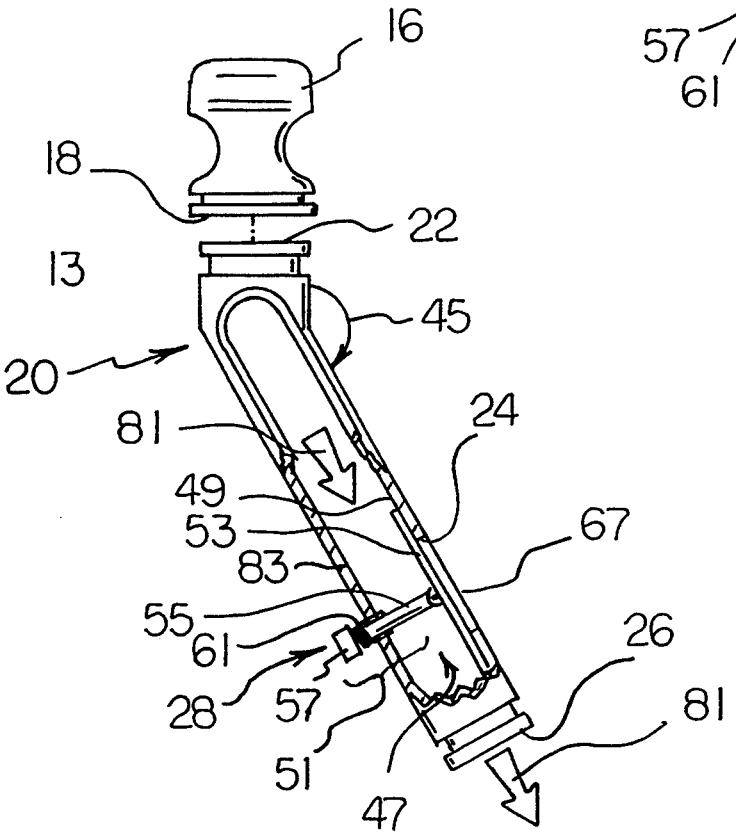
FIG. 5 is partially broken away view of the embodiment of the invention shown in FIG. 4 showing a manually controlled valve in a position directing a diver's exhaled air toward a buoyancy control vest in a buoyancy control inflation mode.

On the other hand, as shown in FIG. 5, when the button element 57 is pressed, the tension in the spring element 61 is overcome, the flapper valve element 53 is moved away from the valve seat 83 into sealing engagement with the first selector valve output port 24. As a result, the first selector valve output port 24 and the flapper valve assembly 67 are blocked, and the exhaled air (shown by directional arrows 81) is directed to the buoyancy control vest 30 through the second selector valve output port 26.

The housing assembly 13 includes a first housing portion 41 which includes the a selector valve input port 22 and a second housing portion 43 which includes the first selector valve output port 24 and the second selector valve output port 26. The first housing portion 41 is oriented with respect to the second housing portion 43 at an obtuse orientation angle 45.

Figure 6:
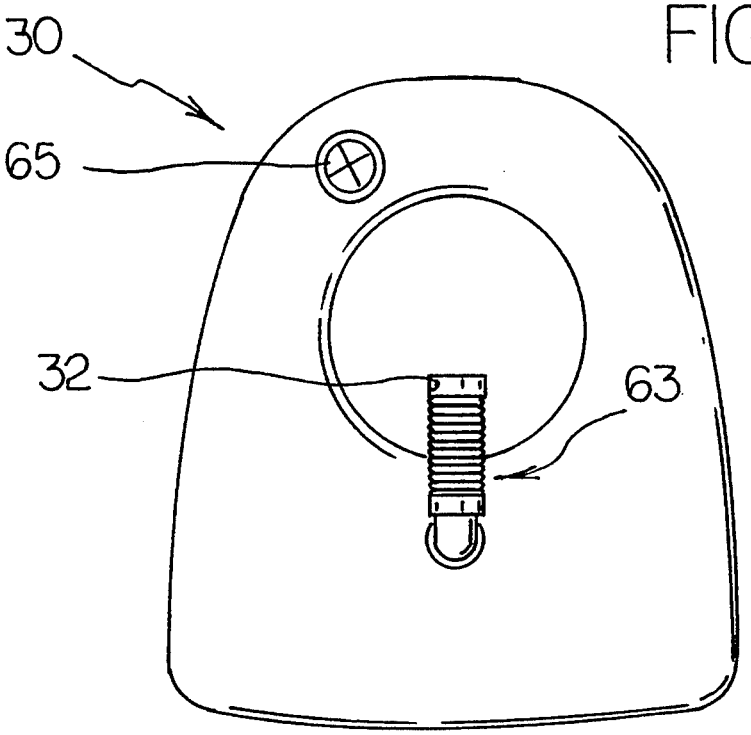
FIG. 6 is a side view of a buoyancy control vest of the invention which includes a manually operated exhaust valve.
Figure 2:
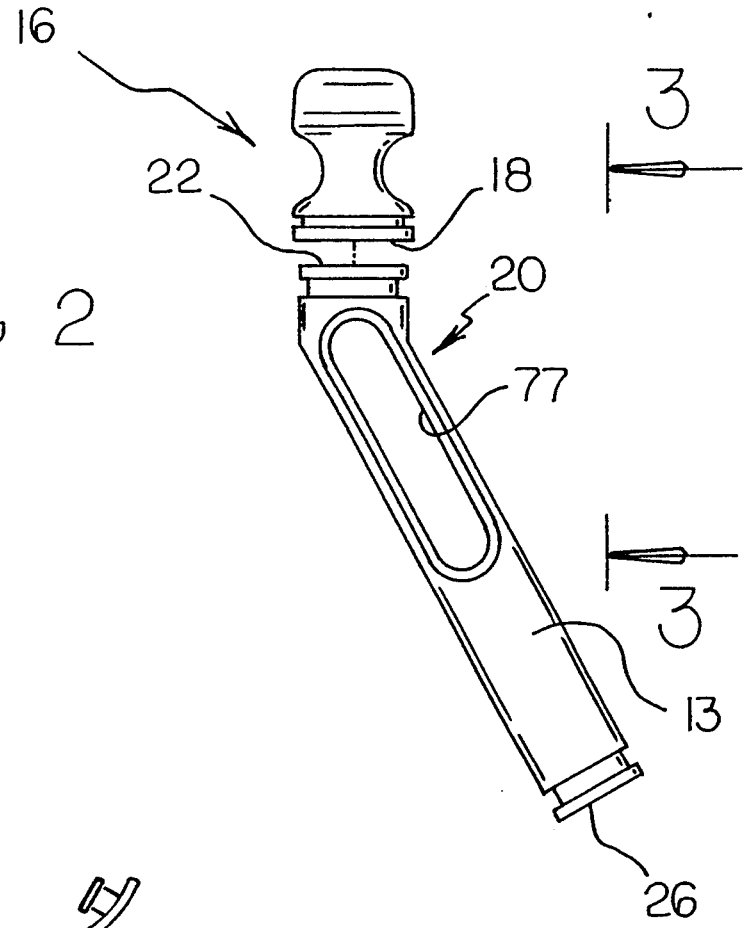
FIG. 2 is a partially exploded side view of the embodiment of the invention shown in FIG. 1 without showing a snorkel attached.
Figure 3:
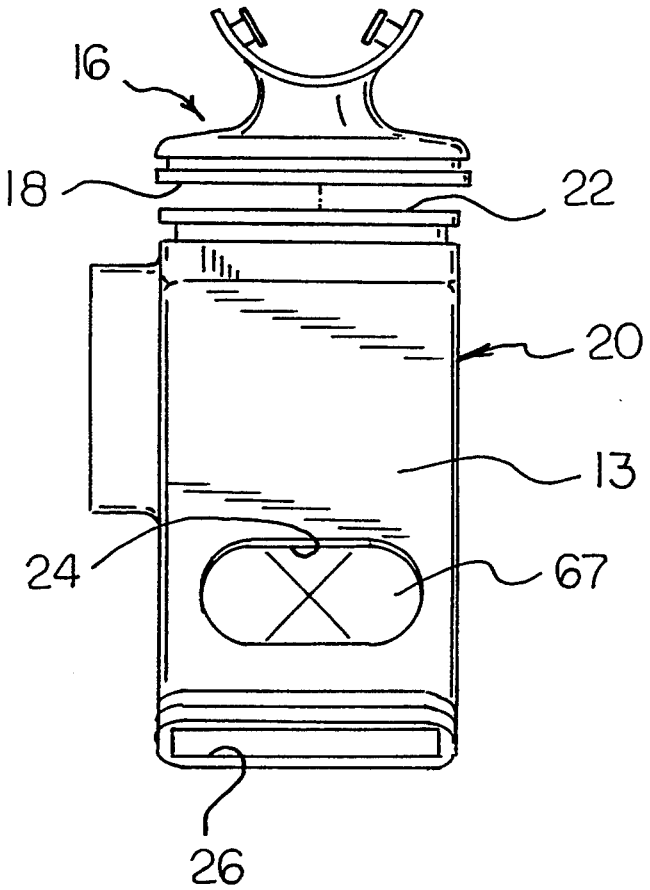
FIG. 3 is a partially exploded front view of the embodiment of the invention shown in FIG. 2.

As shown in FIG. 6, the buoyancy control vest 30 includes an inlet assembly 63 for connection to the selector valve assembly 20, such that a snorkeler's exhaled air can be directed to the buoyancy control vest 30, and a manually-operable exhaust valve 65 which permits air to be exhausted from the buoyancy control vest 30 by manual control of the snorkeler.

Turning to the embodiment of the invention shown in FIG. 7, the snorkel and buoyancy control apparatus 10 includes a snorkel tube 12 for receiving air inhaled by the snorkeler, a first one-way air valve 14 connected to the snorkel tube 12 for permitting air flow into the snorkel tube 12 during inhalation, and a mouthpiece 16 for receiving inhaled air and for supplying the inhaled air to the snorkeler's mouth and lungs. A tube 29 is used to connect the first one-way air valve 14 to the mouthpiece 16. The mouthpiece 16 includes a mouthpiece output port 18 for permitting exhaled air to exit from the snorkeler's mouth. A second one-way air valve 15 is connected to the mouthpiece 16 for permitting air flow from the mouthpiece 16 to a selector valve assembly 20. A tube 31 is used to connect the mouthpiece output port 18 to second one-way air valve 15.

The selector valve assembly 20, connected to the mouthpiece 16 by way of the second one-way air valve 15, receives exhaled air from the mouthpiece 16 and selectively directs exhaled air to either a vent 19 or to a buoyancy control vest 30 for inflation thereof. The buoyancy control vest 30 which includes a first port 32 connected to the selector valve assembly 20.

The mouthpiece 16 includes a mouthpiece input port 17 connected to the snorkel tube 12 by way of the first one-way air valve 14 and also includes a mouthpiece output port 18 for permitting exhaled air to exit from the snorkeler's mouth.

The second one-way air valve 15 is connected to the mouthpiece output port 18, for permitting air flow from the mouthpiece output port 18 to the selector valve assembly 20. The selector valve assembly 20 is connected to the mouthpiece output port 18 by way of the second one-way air valve 15.

The selector valve assembly 20 includes a selector valve input port 22, a first selector valve output port 24, a second selector valve output port 26, and a first manually-actuated output port selector assembly 28. The selector valve input port 22 is connected to the mouthpiece output port 18 by way of the second one-way air valve 15. A tube 33 is used to connect the second one-way air valve 15 to the selector valve input port 22.

The first selector valve output port 24 is vented to outside the selector valve assembly 20 through a vent 19. The second selector valve output port 26 is connected to a buoyancy control vest 30 by way of a first port 32 connected to the second selector valve output port 26. A tube 35 is used to connect the second selector valve output port 26 to the first port 32.

Figure 8:
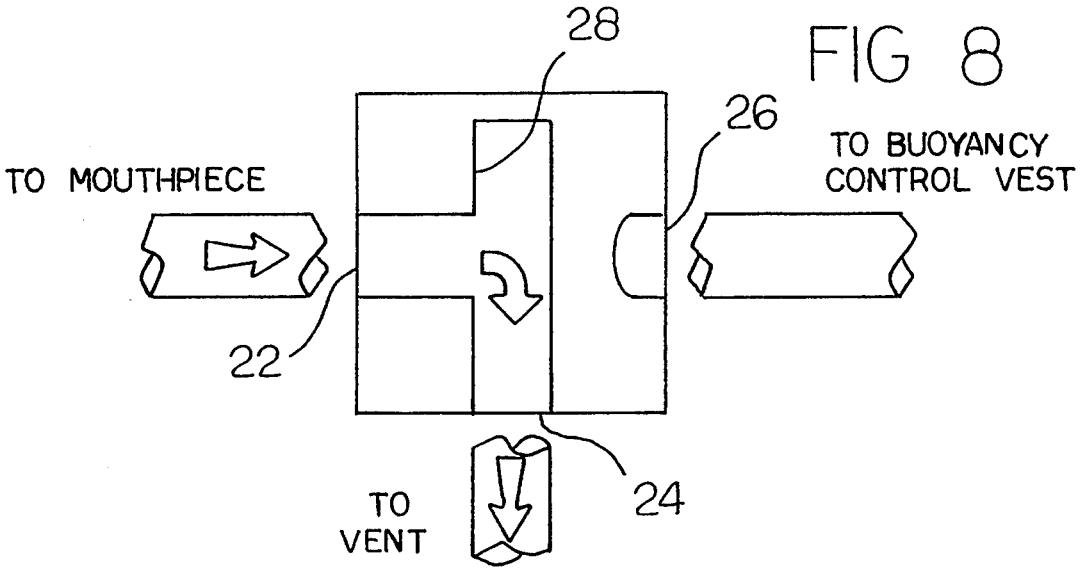
FIG. 8 is a schematic air flow diagram for the selector valve assembly in the embodiment in FIG. 7 in a position connecting exhaled air from the mouthpiece to the vent.
Figure 9:
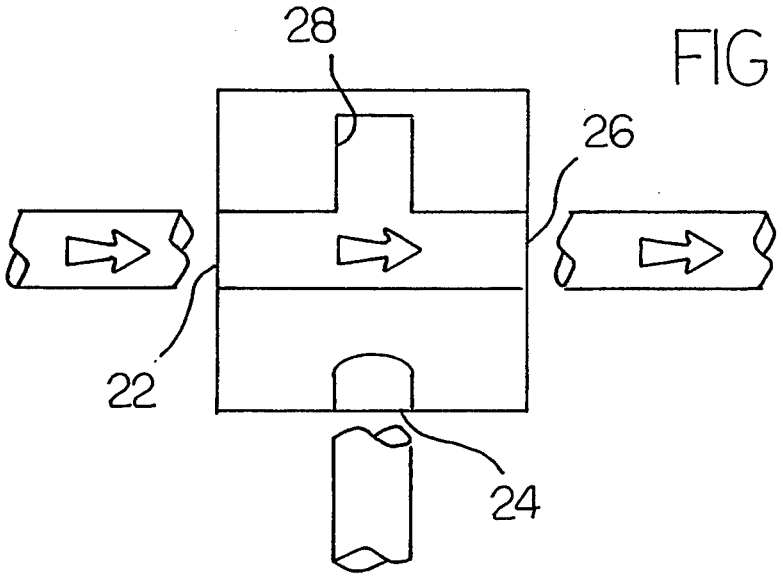
FIG. 9 is a schematic air flow diagram for the selector valve assembly in the embodiment in FIG. 7 in a position connecting exhaled air from the mouthpiece to the buoyancy control vest to inflate the buoyancy control vest.
Figure 10:
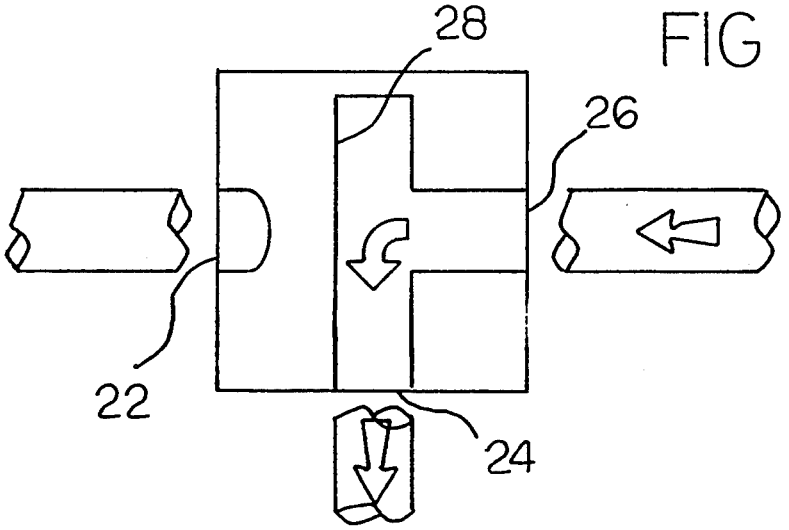
FIG. 10 is a schematic air flow diagram for the selector valve assembly in the embodiment in FIG. 7 in a position connecting air from the buoyancy control vest to the vent to deflate the buoyancy control vest.

Detailed air flow diagrams for the embodiment of the invention shown in FIG. 7 are provided in FIGS. 8–10. In FIG. 8, a T-shaped first manually-actuated output port selector assembly 28 is shown in a first position wherein exhaled air from the mouthpiece 16 is directed to the vent 19. In the position shown in FIG. 8, the state of inflation of the buoyancy control vest 30 is maintained.

In FIG. 9, the first manually-actuated output port selector assembly 28 is shown in a second position wherein exhaled air from the mouthpiece 16 is directed to the buoyancy control vest 30 for inflation thereof.

In FIG. 10, the first manually-actuated output port selector assembly 28 is shown in a third position wherein air inside the buoyancy control vest 30 is directed to the vent 19 for deflation of the buoyancy control vest 30. In this position of the first manually-actuated output port selector assembly 28, the snorkeler would either be inhaling or momentarily holding one's breath but not be exhaling.

Turning to FIGS. 11–16, a third embodiment of the invention is shown. Reference numerals are shown that correspond to like reference numerals that designate like elements shown in the other figures. In addition, the selector valve assembly 20 further includes a third selector valve output port 34 and a second manually-actuated output port selector 38. The buoyancy control vest 30 further includes a second port 36. The second port 36 is connected to the third selector valve output port 34. A tube 37 is used to connect third selector valve output port 34 with second port 36. The second manually-actuated output port selector 38 controls flow of air from the buoyancy control vest 30 to the first selector valve output port 24 and the vent 19 for deflating the buoyancy control vest 30.

Figure 11:
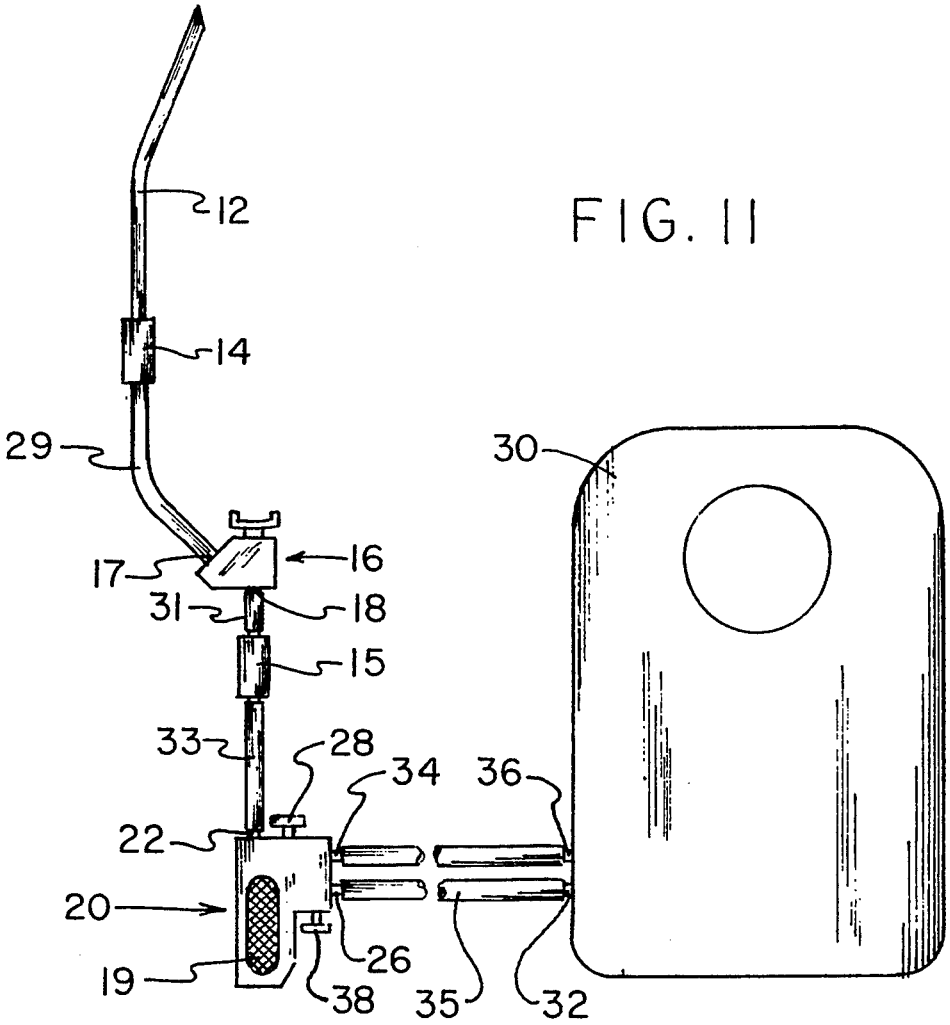
FIG. 11 is an elevational view showing a third preferred embodiment of the snorkel and buoyancy control apparatus of the invention.

A detailed explanation of the operation of the third embodiment of the snorkel and buoyancy control apparatus 10 of the invention shown in FIG. 11 is provided with references to the air flow diagrams shown in FIGS. 13–16.

Figure 12:
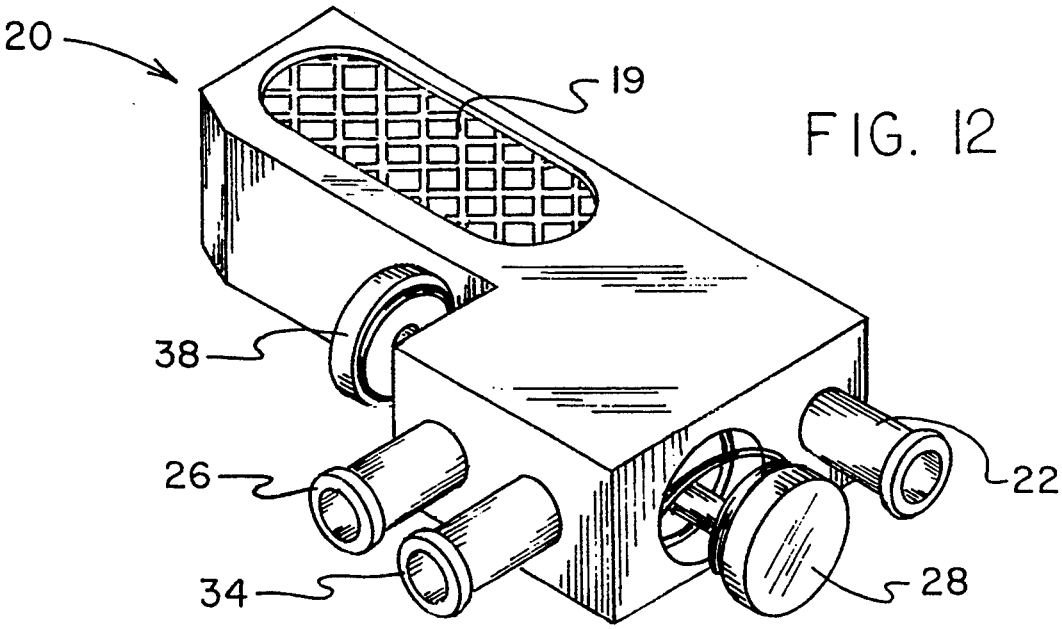
FIG. 12 is an enlarged perspective view of a selector valve assembly used in the embodiment of the invention shown in FIG. 11.

It is noted that the arrangement of the first manually-actuated output port selector assembly 28 and the second manually-actuated output port selector 38 shown in FIGS. 11 and 12 is slightly different from the corresponding arrangement in FIGS. 13–16. This difference is inconsequential. The linear arrangement of the first manually-actuated output port selector assembly 28 and second manually-actuated output port selector 38 in FIGS. 13–16 is provided for purposes of simplicity and ease of understanding.

In FIGS. 13–16, the first manually-actuated output port selector assembly 28 and the second manually-actuated output port selector 38 are shown to be spring-biased linear valves. The first manually-actuated output port selector assembly 28 includes two valve elements for controlling two air channels 21 and 23, respectively. The second manually-actuated output port selector 38 includes one valve element for controlling the air channel 21.

Figure 13:
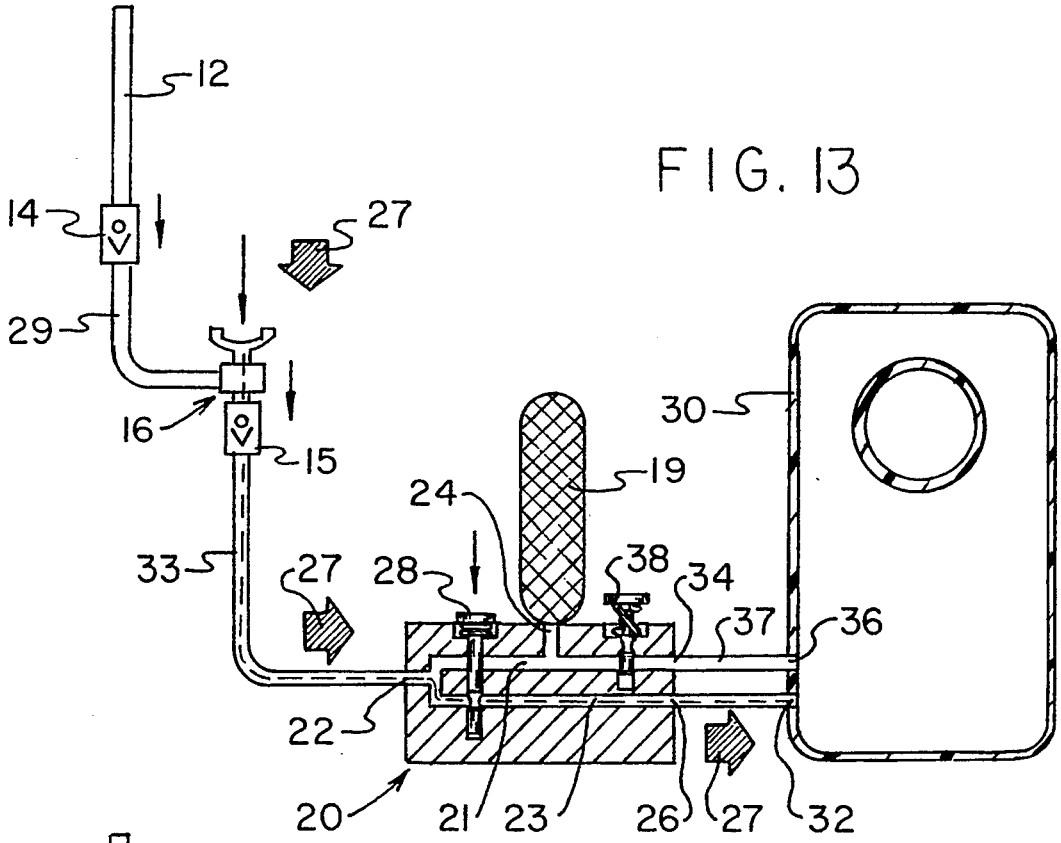
FIG. 13 is an air flow diagram for the embodiment shown in FIG. 11 in a mode wherein air is being inhaled by a snorkeler.
Figure 14:
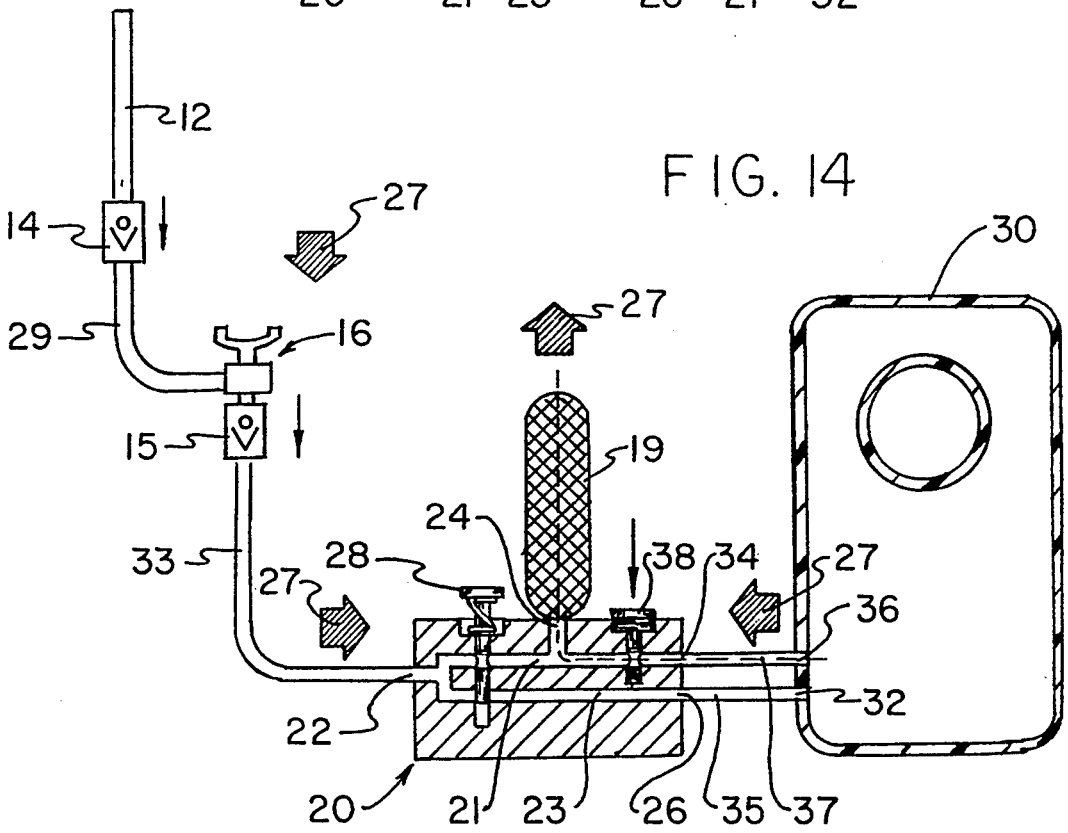
FIG. 14 is an air flow diagram for the embodiment shown in FIG. 11 in a mode wherein air is being exhaled by a snorkeler.
Figure 15:
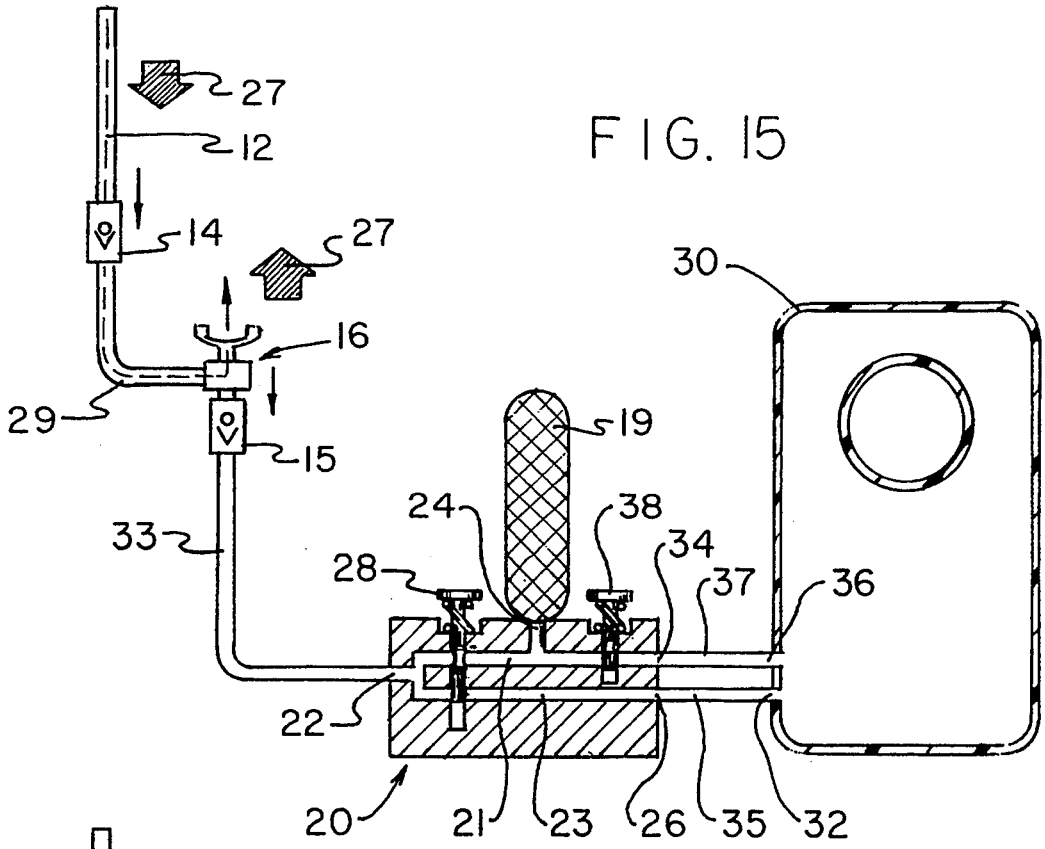
FIG. 15 is an air flow diagram for the embodiment shown in FIG. 11 in a mode wherein air is being exhaled by a snorkeler and is being used to inflate a buoyancy control vest.
Figure 16:
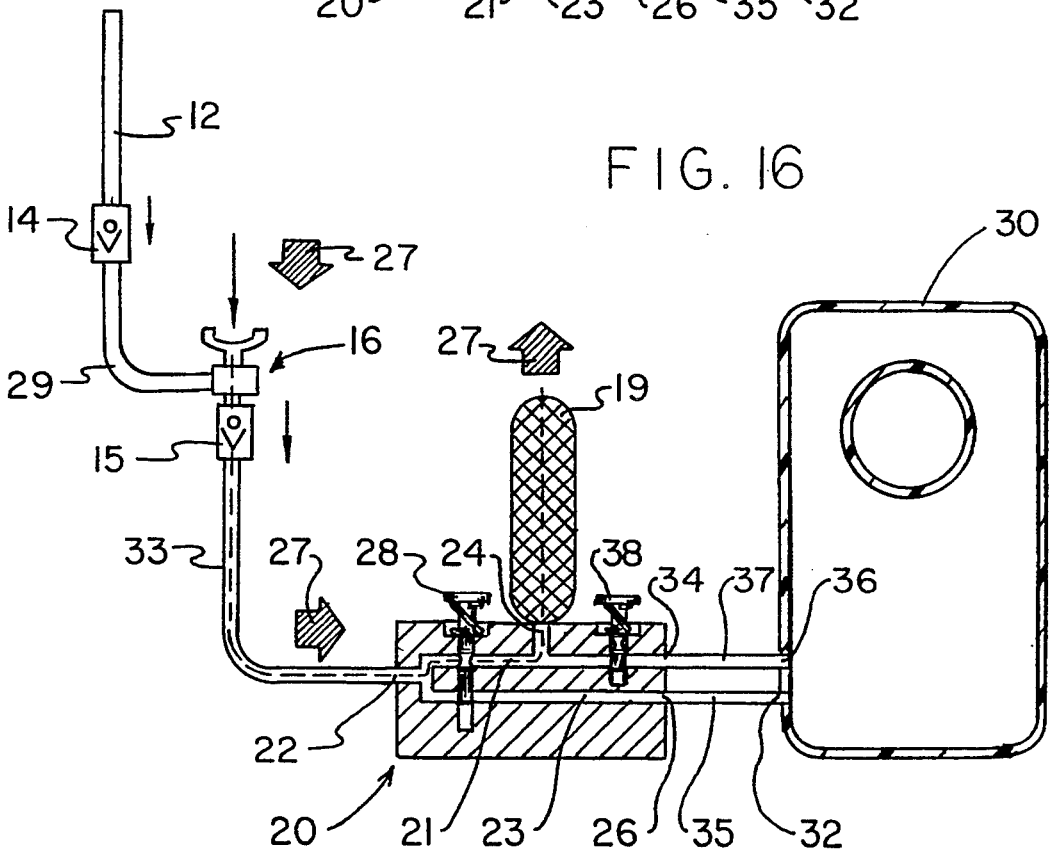
FIG. 16 is an air flow diagram for the embodiment shown in FIG. 11 in a mode wherein air may be exhaled by a snorkeler and the buoyancy control vest is being deflated.

With respect to the first manually-actuated output port selector assembly 28, in FIGS. 13, 14, and 16, the first manually-actuated output port selector assembly 28 is shown permitting air flow through channel 21, but blocking air flow through channel 23. In FIG. 15, the first manually-actuated output port selector assembly-28 blocks air flow in channel 21, but permits air flow in channel 23.

With respect to the second manually-actuated output port selector 38, in FIGS. 13, 14, and 15, the second manually-actuated output port selector 38 blocks air flow from the second port 36 of the buoyancy control vest 30 to the vent 19 through air channel 21. In FIG. 16, the second manually-actuated output port selector 38 permits air to flow from the second port 36 of the buoyancy control vest 30 to the vent 19 through air channel 21, whereby the buoyancy control vest 30 is deflated.

In FIGS. 13–16, direction of air flow is indicated by the large arrows 27. Air flow is also indicated by the dashed lines inside respective air conduits.

More specifically, as shown in FIG. 13, air is being inhaled by the snorkeler.

More specifically, as shown in FIG. 14, air is being exhaled by the snorkeler, and the exhaled air is being passed out the vent 19.

In both FIGS. 13 and 14, the state of inflation of the buoyancy control vest 30 is maintained.

More specifically, as shown in FIG. 15, air is being exhaled by the snorkeler, and the exhaled air is being directed to the buoyancy control vest 30 for inflation thereof.

More specifically, as shown in FIG. 16, air is being released from the buoyancy control vest 30, and the released air is being vented through the vent 19. In FIG. 16, the snorkeler can be either inhaling, exhaling, or holding one's breath.

The components of the snorkel and buoyancy control apparatus of the invention can be made from inexpensive and durable plastic, metal, and rubber materials.

It is apparent from the above that the present invention accomplishes all of the objects set forth by providing a new and improved snorkel and buoyancy control apparatus that is low in cost, relatively simple in design and operation, and which may advantageously be used by a snorkeler to inflate a buoyancy control vest without requiring the snorkeler to remove the snorkel from his/her mouth. Also, with the invention, a person is permitted to inflate the buoyancy control vest without treading water with the snorkel out of the mouth. With the invention, a snorkeler is enabled to change the inflation of the buoyancy control vest during the snorkeling operation. With the invention, inflation of a buoyancy control vest is enabled without direct mouth contact on the vest. With the invention, inflation of a buoyancy control vest is enabled without employing a pressurized tank such as used in scuba diving equipment.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by letters patent of the United States is as follows:

1. A snorkel and buoyancy control apparatus for a snorkeler, comprising:

a snorkel tube assembly for receiving inhaled air, a mouthpiece/selector valve assembly, connected to said snorkel tube assembly, for receiving inhaled air from said snorkel tube assembly and for selectively directing exhaled air to either a flapper valve assembly or to a buoyancy control vest, said mouthpiece/selector valve assembly including a selector valve assembly and a mouthpiece assembly connected together, said selector valve assembly including a first manually-actuated output port selector assembly which enables selective direction of exhaled air either to a flapper valve assembly or to a buoyancy control vest, a flapper valve assembly, connected to said selector valve assembly, for permitting one-way flow of exhaled air from inside said selector valve assembly to outside said selector valve assembly, and a buoyancy control vest, connected to said selector valve assembly, for selectively receiving exhaled air based upon selective operation of said first manually-actuated output port selector assembly.

2. The apparatus of claim 1 wherein said snorkel tube assembly is connected to a selector valve assembly portion of said mouthpiece/selector valve assembly.

3. The apparatus of claim 1 wherein said snorkel tube assembly is connected to a mouthpiece assembly portion of said mouthpiece/selector valve assembly.

4. The apparatus of claim 1 wherein said buoyancy control vest includes:

an inlet assembly for connection to said selector valve assembly, such that a snorkeler's exhaled air can be directed to said buoyancy control vest, and a manually-operable exhaust valve which permits air to be exhausted from said buoyancy control vest by manual control.

5. A snorkel and buoyancy control apparatus for a snorkeler, comprising:

a snorkel tube assembly for receiving inhaled air, a selector valve assembly, connected to said snorkel tube assembly, for receiving inhaled air from said snorkel tube assembly and for selectively directing exhaled air to either a flapper valve assembly or to a buoyancy control vest, wherein said selector valve assembly includes a housing assembly which includes a first selector valve input port, a second selector valve input port connected to said snorkel tube assembly, a first selector valve output port, a second selector valve output port, and a first manually-actuated output port selector assembly, wherein said first selector valve input port is connected to a mouthpiece output port, wherein said first selector valve output port is vented to outside said selector valve assembly, wherein said second selector valve output port is connected to a buoyancy control vest, and wherein said first manually-actuated output port selector assembly is employed to selectively direct exhaled air from either a mouthpiece assembly to said first selector valve output port for venting the exhaled air or from a mouthpiece assembly to said second selector valve output port for inflating a buoyancy control vest, a mouthpiece assembly, connected to said first selector valve input port of selector valve assembly, for receiving inhaled air from said snorkel tube assembly and for supplying the inhaled air to the snorkeler's mouth and lungs, said mouthpiece assembly including a mouthpiece output port connected to said first selector valve input port for permitting air exhaled from the snorkeler's lungs to exit from said mouthpiece assembly and enter said selector valve assembly, a flapper valve assembly, connected to said selector valve assembly, for permitting one-way flow of exhaled air from inside said selector valve assembly to outside said selector valve assembly, and a buoyancy control vest, connected to said second selector valve output port of said selector valve assembly, said buoyancy control vest including a first port connected to said second selector valve output port of said selector valve assembly.

6. The apparatus of claim 5 wherein said snorkel tube includes a one-way valve assembly.

7. The apparatus of claim 5 wherein said flapper valve assembly is installed across said first selector valve output port of said housing assembly of said selector valve assembly.

8. The apparatus of claim 5 wherein said first manually-actuated output port selector assembly includes:

a manually operated valve assembly connected to an interior wall of said housing assembly, wherein said manually operated valve assembly includes a valve element that is capable of manually selectively closing either said first selector valve output port or said second selector valve output port, and a push-button assembly, connected to said housing assembly and in contact with said valve element, for manually controlling said valve element with respect to said first selector valve output port and said second selector valve output port.

9. The apparatus of claim 8 wherein said push-button assembly includes:

a pivoted shaft element pivotally connected at a distal end to said valve element, a button element connected to said pivoted shaft element at proximal end of said pivoted shaft element, and a spring element positioned between said button element and said housing assembly around a portion of said pivoted shaft element, such that said spring element normally urges said valve element into sealing engagement with an interior portion of said housing assembly for blocking air flow to said second selector valve output port and said buoyancy control vest, and such that, when said button element is pressed, said valve element is moved from sealing engagement with said interior portion of said housing assembly to sealing engagement with said first selector valve output port.

10. The apparatus of claim 5 wherein said housing assembly includes:

a first housing portion which includes said a selector valve input port, and a second housing portion which includes said first selector valve output port and said second selector valve output port, wherein said first housing portion is oriented with respect to said second housing portion at an obtuse orientation angle.

* * * * *